US012723793B2

(12) United States Patent
Han et al.

(10) Patent No.: US 12,723,793 B2
(45) Date of Patent: Sep. 1, 2026

(54) HEAT PUMP SYSTEM AND METHOD FOR CONTROLLING THE SAME

(71) Applicant: SAMSUNG ELECTRONICS CO., LTD., Suwon-si (KR)

(72) Inventors: Sangyoon Han, Suwon-si (KR); Taeil Kim, Suwon-si (KR); Naeseong Lee, Suwon-si (KR); Minwoo Lee, Suwon-si (KR); Min Chang, Suwon-si (KR); Seokhyun Jang, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 90 days.

(21) Appl. No.: 18/649,112

(22) Filed: Apr. 29, 2024

(65) Prior Publication Data

US 2025/0020377 A1 Jan. 16, 2025

Related U.S. Application Data

(63) Continuation of application No. PCT/KR2024/004174, filed on Apr. 1, 2024.

(30) Foreign Application Priority Data

Jul. 12, 2023 (KR) ..... 10-2023-0090691
Oct. 11, 2023 (KR) ..... 10-2023-0135492
Nov. 16, 2023 (KR) ..... 10-2023-0159594

(51) Int. Cl.
*F25B 49/02* (2006.01)
*F25B 30/02* (2006.01)

(52) U.S. Cl.
CPC ..... *F25B 49/02* (2013.01); *F25B 30/02* (2013.01); *F25B 2700/193* (2013.01); *F25B 2700/2106* (2013.01)

(58) Field of Classification Search
CPC ..... F25B 49/02; F25B 30/02; F25B 2700/19; F25B 2700/193; F25B 2700/1931;
(Continued)

(56) References Cited

U.S. PATENT DOCUMENTS 8,418,530 B1 4/2013 Scaringe
10,091,505 B2 10/2018 Park
(Continued)

FOREIGN PATENT DOCUMENTS

JP 2012-255648 12/2012
JP 2015-048995 3/2015
(Continued)

OTHER PUBLICATIONS

English translation of Maeda et al. (WO 2017094059 A1) (Year: 2017).*
(Continued)

*Primary Examiner* — Miguel A Diaz
(74) *Attorney, Agent, or Firm* — Nixon & Vanderhye P.C.

(57) ABSTRACT

A heat pump system may include: a compressor configured to compress a refrigerant; a refrigerant-water heat exchanger configured to perform heat exchange between the compressed refrigerant and inlet water; an expansion valve configured to expand the refrigerant condensed in the refrigerant-water heat exchanger; an outdoor heat exchanger configured to perform heat exchange between the refrigerant expanded in the expansion valve and outdoor air; a high pressure sensor configured to detect a high pressure saturation temperature of the refrigerant compressed in the compressor; an inlet water temperature sensor configured to detect a temperature of water flowing into the refrigerant-water heat exchanger; a condensation temperature sensor configured to detect a temperature of the refrigerant condensed in the refrigerant-water heat exchanger; an outdoor
(Continued)

temperature sensor configured to detect an outdoor temperature; and a controller including at least one processor, comprising processing circuitry, individually and/or collectively, configured to: determine a reference supercooling degree of the refrigerant based on detection of outdoor temperature by the outdoor temperature sensor and inlet water temperature by the inlet water temperature sensor and an operating frequency of the compressor, determine a current degree of supercooling of the refrigerant based on detection of pressure saturation temperature by the high pressure sensor and condensation temperature by the condensation temperature sensor, and determine whether the refrigerant leaks by comparing the reference supercooling degree and the current degree of supercooling.

15 Claims, 15 Drawing Sheets

(58) Field of Classification Search
CPC ..... F25B 2700/1933; F25B 2700/21; F25B 2700/2102; F25B 2700/2103; F25B 2700/2106; F25B 2700/2115; F25B 2700/2116; F25B 2500/22; F25B 2500/221; F25B 2500/222
See application file for complete search history.

(56) References Cited

U.S. PATENT DOCUMENTS

| | | | | |
|---|---|---|---|---|
| 11,143,439 | B2 | 10/2021 | Matsuda | |
| 11,435,101 | B2 | 9/2022 | Branson | |
| 11,609,032 | B2 | 3/2023 | Butler | |
| 2009/0199581 | A1* | 8/2009 | Ushijima | F25B 30/02 62/238.7 |
| 2010/0236283 | A1* | 9/2010 | Ballet | F25B 43/003 96/113 |
| 2013/0312443 | A1 | 11/2013 | Tamaki et al. | |
| 2014/0196483 | A1 | 7/2014 | Okazaki | |
| 2016/0356534 | A1 | 12/2016 | Hatada et al. | |
| 2019/0331346 | A1 | 10/2019 | Kawashima | |
| 2019/0346191 | A1 | 11/2019 | Minamisako | |
| 2023/0077481 | A1 | 3/2023 | Hong | |
| 2023/0122568 | A1 | 4/2023 | Cornelis | |

FOREIGN PATENT DOCUMENTS

| | | | | |
|---|---|---|---|---|
| JP | 5818900 | B2 | 10/2015 | |
| JP | 2017075761 | | 4/2017 | |
| JP | 6687116 | B2 | 4/2020 | |
| JP | 2021148339 | A | 9/2021 | |
| JP | 2022150675 | A | 10/2022 | |
| JP | 2022-179215 | | 12/2022 | |
| JP | 7412221 | | 1/2024 | |
| KR | 19940011908 | A | 6/1994 | |
| KR | 100434386 | B1 | 7/2004 | |
| KR | 102006479 | B1 | 8/2019 | |
| KR | 102002016 | B1 | 10/2019 | |
| KR | 20210108241 | A | 9/2021 | |
| KR | 102443308 | B1 | 9/2022 | |
| WO | 2012/111063 | | 8/2012 | |
| WO | WO-2017094059 | A1 * | 6/2017 | F25B 40/02 |
| WO | 2017/199391 | | 11/2017 | |

OTHER PUBLICATIONS

Search Report and Written Opinion dated Jul. 22, 2024 issued in International Patent Application No. PCT/KR2024/004174.
Extended European Search Report dated Jun. 19, 2026 for EP Application No. 24839853.9.

* cited by examiner

HEAT PUMP SYSTEM AND METHOD FOR CONTROLLING THE SAME

CROSS-REFERENCE TO RELATED APPLICATIONS

This application is a continuation of International Application No. PCT/KR2024/004174 designating the United States, filed on Apr. 1, 2024, in the Korean Intellectual Property Receiving Office and claiming priority to Korean Patent Application Nos. 10-2023-0090691, filed on Jul. 12, 2023, 10-2023-0135492, filed on Oct. 11, 2023, and 10-2023-0159594, filed on Nov. 16, 2023, in the Korean Intellectual Property Office, the disclosures of each of which are incorporated by reference herein in their entireties.

BACKGROUND

Field

The disclosure relates to a heat pump system and a method for controlling the same, and for example, to a heat pump system that may supply hot water through heat exchange, and a method for controlling the same.

Description of Related Art

In general, heat moves naturally from a high temperature to a low temperature. Accordingly, in order to move heat from a low temperature to a high temperature, some external action is required to be applied, which is the principle of a heat pump. A heat pump performs cooling and heating (Air to Air) and water supply (Air to Water) using the heat generated and recovered during a process of compression, condensation, and evaporation of refrigerant.

A multi-type cooling and heating device using a heat pump method (hereinafter, referred to as an 'air conditioning system') may include an outdoor unit, an indoor unit, and a hydro unit, and may use the heat from the heat pump for floor heating, cooling and heating of indoor air, and the like.

In an existing heat pump system, refrigerant leak is detected based on a current pressure compared to a saturation pressure when the heat pump system is stopped. However, in the case of R290, a propane refrigerant, a saturation pressure is relatively low compared to other refrigerants, and thus even when refrigerant leak is detected at the same rate, an absolute value of the pressure difference is small. In addition, in detecting a refrigerant leak based on a temperature difference of the refrigerant in a heat exchanger when the heat pump system is stopped and after the heat pump system is started, detection may be made only when a large amount of refrigerant leak has occurred.

Furthermore, in the case of a hot water tank for hot water supply, repeated startup and shutdown may lead to low energy efficiency due to heat loss. Accordingly, a power-saving operation has been implemented by considering usage pattern learning and hot water heat quantity. However, a hot water tank equipped with a power-saving operation function requires a large number of sensors, which increases the design configuration.

SUMMARY

Embodiments of the disclosure may provide a heat pump system and a method for controlling the same that may determine whether a refrigerant leak has occurred based on a degree of supercooling of refrigerant, thereby detecting even small amount of refrigerant leakage without stopping the heat pump system.

Embodiments of the disclosure may provide a heat pump system and a method for controlling the same that may perform a power-saving operation by predicting a hot water usage pattern and a hot water usage heat quantity, without using multiple sensors.

According to an example embodiment of the disclosure, a heat pump system may include: a compressor configured to compress a refrigerant; a refrigerant-water heat exchanger configured to perform heat exchange between the compressed refrigerant and inlet water; an expansion valve configured to expand the refrigerant condensed in the refrigerant-water heat exchanger; an outdoor heat exchanger configured to perform heat exchange between the refrigerant expanded in the expansion valve and outdoor air; a high pressure sensor configured to detect a high pressure saturation temperature of the refrigerant compressed in the compressor; an inlet water temperature sensor configured to detect a temperature of water flowing into the refrigerant-water heat exchanger; a condensation temperature sensor configured to detect a temperature of the refrigerant condensed in the refrigerant-water heat exchanger; an outdoor temperature sensor configured to detect an outdoor temperature; and a controller, comprising at least one processor, comprising processing circuitry, individually and/or collectively configured to: determine a reference supercooling degree of the refrigerant based on detection results of the outdoor temperature sensor and the inlet water temperature sensor and an operating frequency of the compressor, determine a current degree of supercooling of the refrigerant based on detection of the high pressure sensor and the condensation temperature sensor, and determine whether the refrigerant leaks by comparing the reference supercooling degree and the current degree of supercooling.

BRIEF DESCRIPTION OF THE DRAWINGS

The above and other aspects, features and advantages of certain embodiments of the present disclosure will be more apparent from the following detailed description, taken in conjunction with the accompanying drawings, in which.

DETAILED DESCRIPTION

Figure 1:
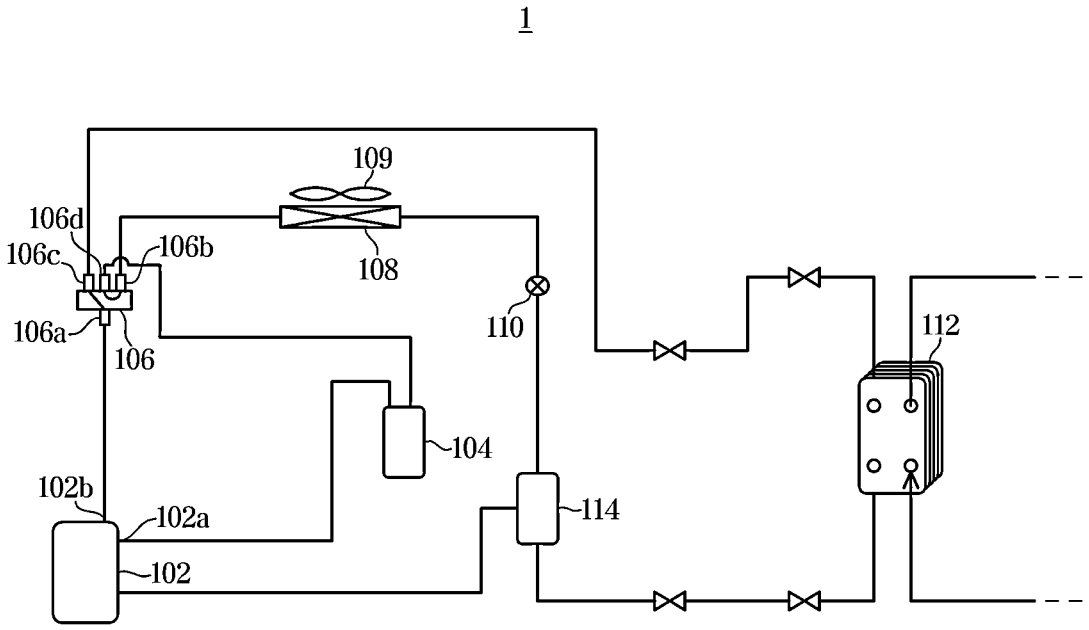
FIG. 1 is a diagram illustrating an example configuration of a heat pump system according to various embodiments.

Various embodiments of the disclosure and terms used therein are not intended to limit the technical features described in the disclosure to particular embodiments, and it should be construed as including various modifications, equivalents, or alternatives of a corresponding embodiment.

With regard to description of drawings, similar reference numerals may be used for similar or related components.

A singular form of a noun corresponding to an item may include one item or a plurality of the items unless context clearly indicates otherwise.

As used herein, each of the expressions "A or B," "at least one of A and B," "at least one of A or B," "A, B, or C," "at least one of A, B, and C," and "at least one of A, B, or C," may include one or all possible combinations of the items listed together with a corresponding expression among the expressions.

The term "and/or" includes any and all combinations of one or more of a plurality of associated listed items.

The terms such as "~part", "~member", "~module", and the like may be embodied as hardware or software. According to embodiments, a plurality of "~parts", "~members", or "~modules" may be embodied as a single element, or a single "~part", "~member", or "~module" may include a plurality of elements.

It will be understood that the terms "first", "second", etc., may be used only to distinguish one component from other components, not intended to limit the corresponding component in other aspects (e.g., importance or order).

When it is said that one (e.g., first) component is "coupled" or "connected" to another (e.g., second) component, with or without the terms "functionally" or "communicatively". When referenced, one component may be connected to the another component directly (e.g., by wire), wirelessly, or through a third component.

It will be understood that when the terms "includes," "comprises," "including," and/or "comprising," when used in this disclosure, specify the presence of stated features, figures, steps, operations, components, members, or combinations thereof, but do not preclude the presence or addition of one or more other features, figures, steps, operations, components, members, or combinations thereof.

An expression that one component is "connected", "coupled", "supported", or "in contact" with another component includes a case in which the components are directly "connected", "coupled", "supported", or "in contact" with each other and a case in which the components are indirectly "connected", "coupled", "supported", or "in contact" with each other through a third component.

It will also be understood that when one component is referred to as being "on" or "over" another component, it may be directly on the other component or intervening components may also be present.

FIG. 1 is a diagram illustrating an example configuration of a heat pump system according to various embodiments.

A heat pump system 1 may include a compressor 102, a refrigerant-water heat exchanger 112, an expansion valve 110, an outdoor heat exchanger 108, a flow path switching valve 106 and an accumulator 104.

The compressor 102 may compress a low-temperature and low-pressure refrigerant drawn in through an inlet side 102*a* to form a high-temperature and high-pressure refrigerant, and then discharge the high-temperature and high-pressure refrigerant through an outlet side 102*b*. The compressor 102 may be configured as an inverter compressor whose compression capacity varies depending on an input frequency, or may be configured as a combination of a plurality of constant-speed compressors with a constant compression capacity. The inlet side 102*a* of the compressor 102 is connected to the accumulator 104, and the outlet side 102*b* of the compressor 102 is connected to the flow path switching valve 106. The flow path switching valve 106 is also connected to the accumulator 104.

The accumulator 104 may be installed between the inlet side 102*a* of the compressor 102 and the flow path switching valve 106. In response to an inflow of a condensed liquid refrigerant through the flow path switching valve 106, the accumulator 104 may temporarily store a mixture of oil and refrigerant, and separate the non-vaporized liquid refrigerant to prevent and/or inhibit the liquid refrigerant from being drawn into the compressor 102. Accordingly, damage to the compressor 102 may be prevented and/or reduced. The gas refrigerant separated by the accumulator 104 may be drawn into the inlet side 102*a* of the compressor 102.

The flow path switching valve 106 may be configured as a four-way valve, and switch a flow of the refrigerant discharged from the compressor 102 according to an operation mode (cooling or heating), thereby forming a refrigerant flow path required for a corresponding operation mode. The flow path switching valve 106 may include a first port 106*a* connected to the outlet side 102*b* of the compressor 100, a second port 106*b* connected to the outdoor heat exchanger 108, a third port 106*c* connected to the refrigerant-water heat exchanger 112 side, and a fourth port 106*d* connected to the accumulator 104 which is the inlet side 102*a* of the compressor 100.

The outdoor heat exchanger 108 may operate as a condenser in a cooling mode and may operate as an evaporator in a heating mode. A first expansion valve 110 may be connected to one side of the outdoor heat exchanger 108. An outdoor fan 109 may be installed in the outdoor heat exchanger 108 to increase heat exchange efficiency between the refrigerant and outdoor air.

The expansion valve 110 may be configured as an electronic expansion valve, expand the refrigerant, control a flow rate of the refrigerant, and block the flow of the refrigerant when required. The expansion valve 110 may be replaced with an expansion device having a different structure that performs the above-described function.

Inside the refrigerant-water heat exchanger 112, a plurality of heat exchange plates through which the refrigerant passes and a plurality of heat exchange plates through which water passes are installed alternately. Through heat exchange between the heat exchange plates through which the refrigerant passes and the heat exchange plates through which the water passes, cold water/hot water may be generated. The refrigerant compressed in the compressor 102 may be delivered to the refrigerant-water heat exchanger 112. The cold water/hot water generated in the refrigerant-water heat exchanger 112 may be supplied to a water tank, a fan coil unit, a floor cooling/heating device, and the like, and may be used for cold/hot water supply and cooling/heating.

Figure 2:
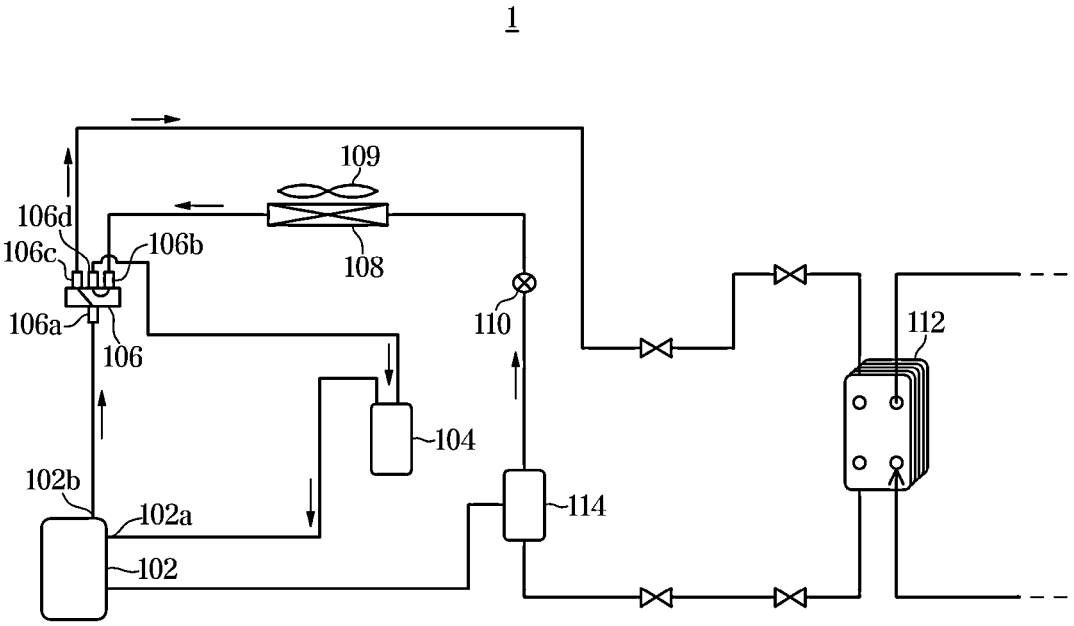
FIG. 2 is a diagram illustrating an example refrigerant flow during a heating operation of a heat pump system according to various embodiments.

FIG. 2 is a diagram illustrating example refrigerant flow during a heating operation of a heat pump system according to various embodiments.

The controller 10 (refer to FIG. 4) may operate the flow path switching valve 106 to form a refrigerant flow path connecting the first port 106*a* with the third port 106*c* and connecting the second port 106*b* with the fourth port 106*d*.

Accordingly, the refrigerant discharged from the compressor 102 may flow into the refrigerant-water heat exchanger 112 through the flow path switching valve 106.

The refrigerant flowing into the refrigerant-water heat exchanger 112 may flow to the outdoor heat exchanger 108 through the refrigerant-water heat exchanger 112. The refrigerant that has passed through the outdoor heat exchanger 108 may pass through the flow path switching valve 106 again and may be drawn into the compressor 102.

Accordingly, the heat pump system 1 may, for example, and without limitation, form a refrigerant cycle that circulates in the order of the compressor 102→the flow path switching valve 106→the refrigerant-water heat exchanger 112→the expansion valve 110→the outdoor heat exchanger 108→the flow path switching valve 106→the accumulator 104→the compressor 102, thereby performing a heating operation.

The heat pump system 1 according to the disclosure may further include a supercooling heat exchanger 114.

The supercooling heat exchanger 114 may be located between the refrigerant-water heat exchanger 112 and the expansion valve 110 to flow the refrigerant to the compressor 102.

In this case, the compressor 102 may perform two-stage refrigerant compression.

The compressor 102 may include a first compression portion in which the refrigerant that has passed through the refrigerant-water heat exchanger 112 is introduced and compressed, and a second compression portion in which both the refrigerant that has passed through the first compression portion and the refrigerant branched and injected from the supercooling heat exchanger 114, which is located between the refrigerant-water heat exchanger 112 and the expansion valve 110, are introduced and compressed.

In other words, injection of the refrigerant into the compressor 102 using the supercooling heat exchanger 114 may be performed by extracting the refrigerant that has passed through the refrigerant-water heat exchanger 112 and injecting only vapor refrigerant into an injection port of the compressor 102.

Accordingly, the compressor 102 may additionally compress not only the refrigerant that has passed through the refrigerant-water heat exchanger 112 according to the above-described refrigerant cycle, but also the refrigerant that is branched and injected from the supercooling heat exchanger 114.

As a result, an efficiency of the compressor 102 may be improved by supplying the vapor refrigerant to the injection port of the compressor 102, and a capacity of the condenser may be increased by increasing a flow rate of the refrigerant in the condenser. In addition, by further securing a degree of supercooling of the refrigerant on a discharge side in the refrigerant-water heat exchanger (112, an internal heat exchanger), an operation may be efficiently performed.

Figure 3:
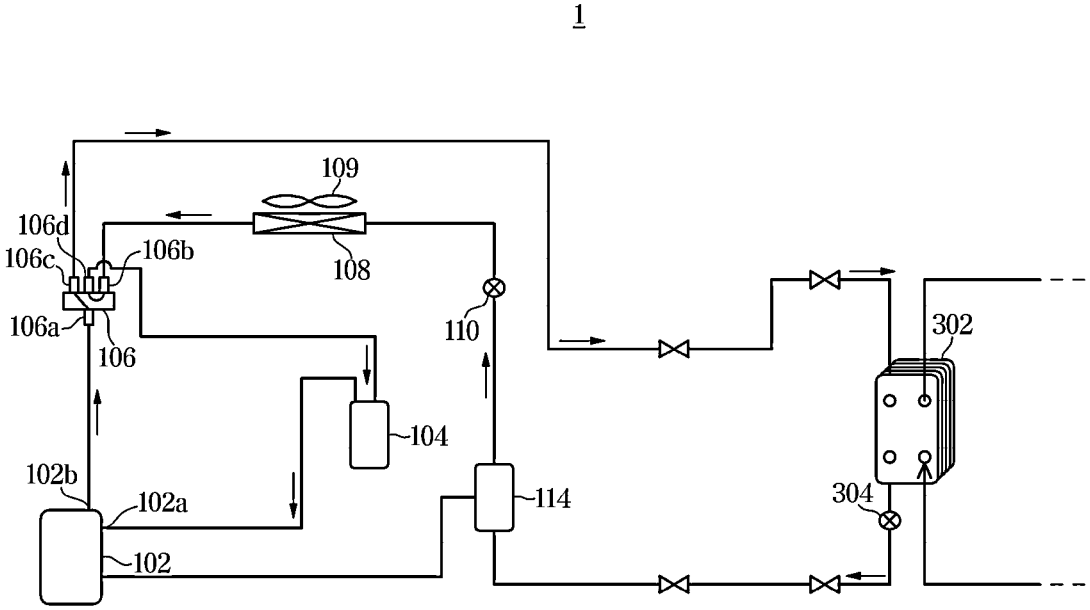
FIG. 3 is a diagram illustrating an example refrigerant flow during a cooling operation of a heat pump system according to various embodiments.

FIG. 3 is a diagram illustrating example refrigerant flow during a cooling operation of a heat pump system according to various embodiments.

The controller 10 (refer to FIG. 4) may operate the flow path switching valve 106 to form a refrigerant flow path connecting the first port 106*a* with the second port 106*b* and connecting the third port 106*c* with the fourth port 106*d*.

Accordingly, the refrigerant discharged from the compressor 102 may flow into an indoor unit through the flow path switching valve 106 and the outdoor heat exchanger 108. In this instance, the outdoor heat exchanger 108 operates as a condenser.

The refrigerant flowing into the indoor unit may pass through the refrigerant-water heat exchanger 112, and the refrigerant that has passed through the refrigerant-water heat exchanger 112 may be drawn into the compressor 102 again through the flow path switching valve 106.

Accordingly, the heat pump system 1 may, for example, and without limitation, form a refrigerant cycle that circulates in the order of the compressor 102→the flow path switching valve 106→the outdoor heat exchanger 108→the refrigerant-water heat exchanger 112→the flow path switching valve 106→the accumulator 104→the compressor 102, thereby performing a cooling operation.

The configuration of the heat pump system 1 and the flow of refrigerant have been described by way of non-limiting example above. Hereinafter, operations for detecting refrigerant leak in the heat pump system 1 are described in greater detail with reference to the drawings.

Figure 4:
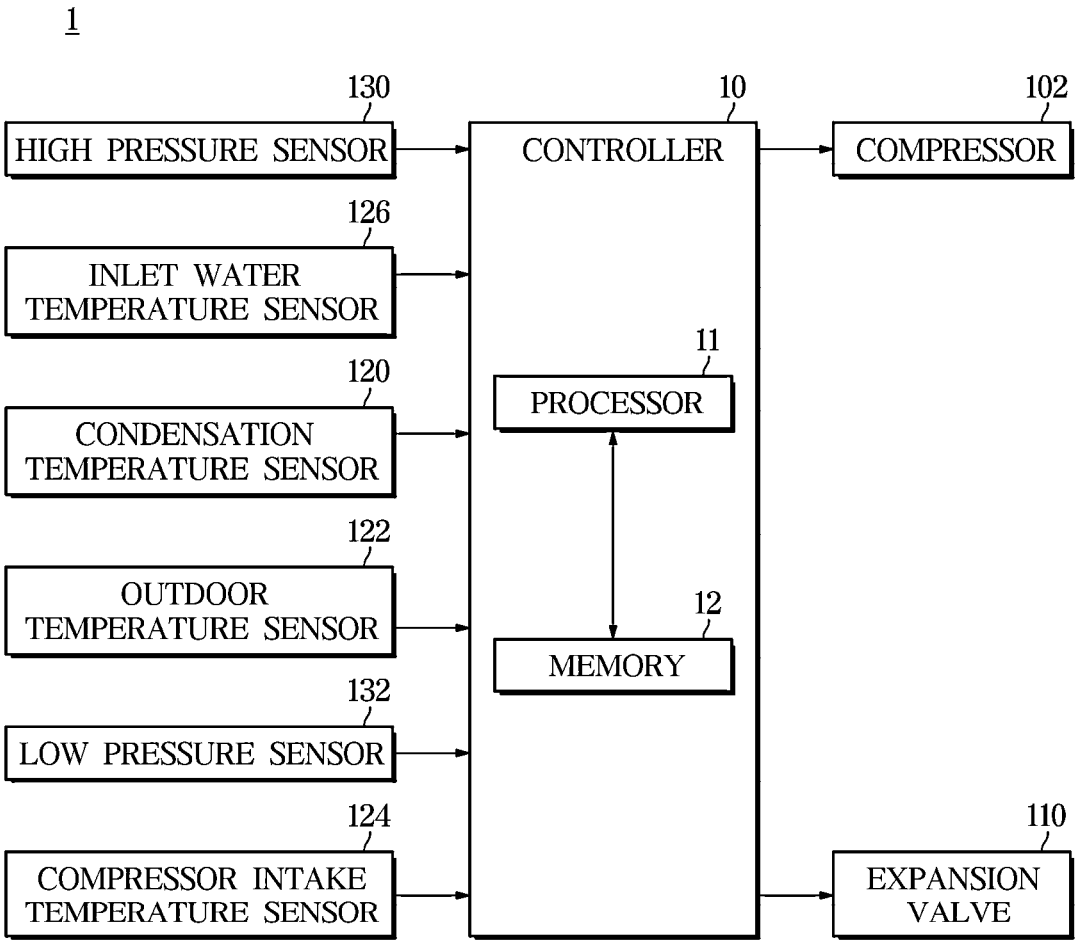
FIG. 4 is a block diagram illustrating an example configuration of a heat pump system according to various embodiments.
Figure 5:
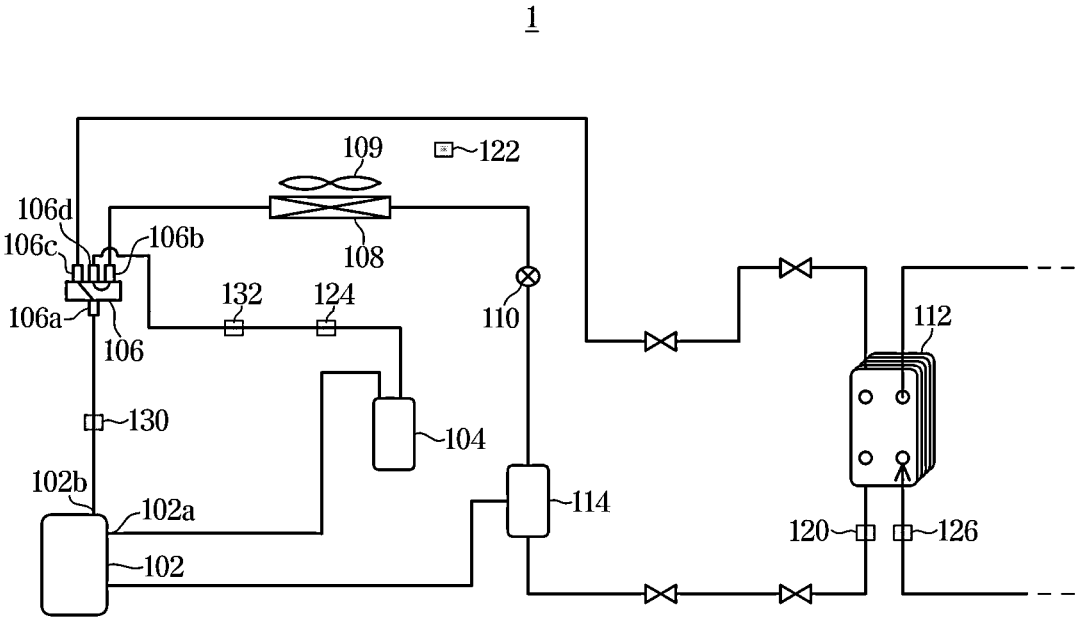
FIG. 5 is a diagram illustrating a plurality of sensors included in a heat pump system according to various embodiments.

FIG. 4 is a block diagram illustrating an example configuration of a heat pump system according to various embodiments. FIG. 5 is a diagram illustrating a plurality of sensors that may be included in a heat pump system according to various embodiments.

The heat pump system 1 may include the compressor 102, the refrigerant-water heat exchanger 112, the outdoor heat exchanger 108, the expansion valve 110, and the controller 10. The controller 10 may include a processor (e.g., including processing circuitry) 11 and a memory 12.

In addition, the heat pump system 1 may further include a high pressure sensor 130, an inlet water temperature sensor 126, a condensation temperature sensor 120, an outdoor temperature sensor 122, a low pressure sensor 132, and a compressor intake temperature sensor 124.

The high pressure sensor 130 may detect a high pressure saturation temperature of the refrigerant compressed in the compressor, and the low pressure sensor 132 may detect a low pressure saturation temperature of the refrigerant flowing into the compressor.

The inlet water temperature sensor 126 may detect a temperature of water flowing into the refrigerant-water heat exchanger 112 before heat exchange between water and the refrigerant occurs in the refrigerant-water heat exchanger 112.

The condensation temperature sensor 120 may detect a temperature of the refrigerant condensed by exchanging heat with water while passing through the refrigerant-water heat exchanger 112.

The compressor intake temperature sensor 124 may detect a temperature of the refrigerant flowing into the compressor.

The outdoor temperature sensor 122 may detect an outdoor temperature.

Various information detected by the above-described sensors may be used in a control process of the controller 10, which is described in detail below.

The compressor may compress the refrigerant, and the refrigerant-water heat exchanger 112 may perform heat exchange between the compressed refrigerant and inlet water. The expansion valve 110 may expand the refrigerant condensed by passing through the refrigerant-water heat exchanger 112.

The outdoor heat exchanger 108 may perform heat exchange between the refrigerant expanded in the expansion valve 110 and outdoor air. An outdoor fan (not shown) may be installed in the outdoor heat exchanger 108 to increase a heat exchange efficiency between the refrigerant and outdoor air.

The controller 10 may include the memory 12 storing a control program and control data for overall control of the heat pump system 1, such as the expansion valve 110, the compressor, and the like, and may include the processor 11 generating a control signal according to the control program and control data stored in the memory 12. The memory 12 and the processor 11 may be provided integrally or separately.

The memory 12 may store temperatures and pressures detected by various sensors, and may store programs and data for overall control of the heat pump system 1, such as the expansion valve 110, the compressor, and the like.

The memory 12 may include a volatile memory such as static random access memory (S-RAM), dynamic random access memory (D-RAM), and the like, for temporarily storing data, and may include a non-volatile memory such as read only memory (ROM), erasable programmable read only memory (EPROM), electrically erasable programmable read only memory (EEPROM), etc., for storing data for a long period of time.

The processor 11 may include various types of logic circuits and an arithmetic circuits, may process data according to the program provided by the memory 12, and may generate a control signal according to the processing results. The processor 11 according to an embodiment of the disclosure may include various processing circuitry and/or multiple processors. For example, as used herein, including the claims, the term "processor" may include various processing circuitry, including at least one processor, wherein one or more of at least one processor, individually and/or collectively in a distributed manner, may be configured to perform various functions described herein. As used herein, when "a processor", "at least one processor", and "one or more processors" are described as being configured to perform numerous functions, these terms cover situations, for example and without limitation, in which one processor performs some of recited functions and another processor(s) performs other of recited functions, and also situations in which a single processor may perform all recited functions. Additionally, the at least one processor may include a combination of processors performing various of the recited/disclosed functions, e.g., in a distributed manner. At least one processor may execute program instructions to achieve or perform various functions.

Figure 6:
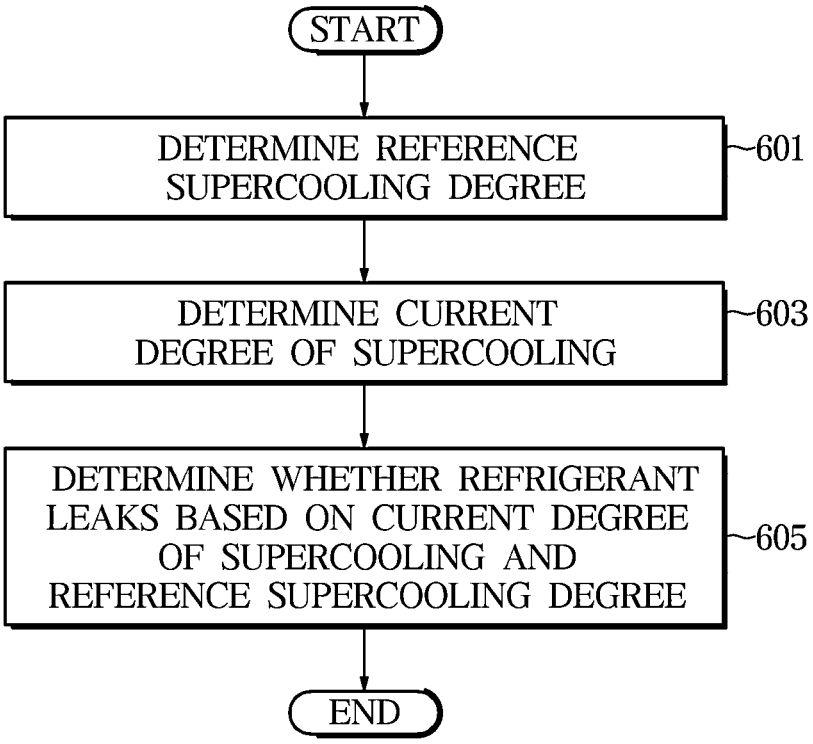
FIG. 6 is a flowchart illustrating an example method for controlling a heat pump system according to various embodiments.

FIG. 6 is a flowchart illustrating an example method for controlling a heat pump system according to various embodiments.

The controller 10 may determine a reference supercooling degree of a refrigerant (601) based on an outdoor temperature detected by the outdoor temperature sensor 122, an inlet water temperature detected by the inlet water temperature sensor 126, and an operating frequency of the compressor.

The reference supercooling degree may be a supercooling value for determining whether the refrigerant leaks, and for example, may be determined according to [Equation 1] below.

$$\text{Reference supercooling degree} = \{A * \text{Inlet water temperature} - B * \text{Outdoor temperature} + C * \text{Compressor frequency} + D\} * E \quad \text{[Equation 1]}$$

where A denotes an inlet water temperature coefficient, B denotes an outdoor temperature coefficient, C denotes a frequency coefficient, D denotes a constant term, and E denotes a ratio and may have different values depending on the compressor, the refrigerant-water heat exchanger 112 and the outdoor heat exchanger 108.

The controller 10 may determine a current degree of supercooling of the refrigerant (603) based on a high pressure saturation temperature of the refrigerant detected by the high pressure sensor 130 and a temperature of the condensed refrigerant detected by the condensation temperature sensor 120.

For example, the current degree of supercooling may be determined according to [Equation 2] below.

$$\text{Current degree of supercooling} = \{\text{high pressure saturation temperature} - \text{temperature of condensed refrigerant}\} \quad \text{[Equation 2]}$$

The controller 10 may determine whether the refrigerant leaks by comparing the current degree of supercooling with the reference supercooling degree calculated according to the above equations (605).

Hereinafter, operations of controlling the expansion valve 110 to reach a reference superheating degree and then comparing the reference supercooling degree and the current degree of supercooling are described in greater detail with reference to the drawings.

Figure 7:
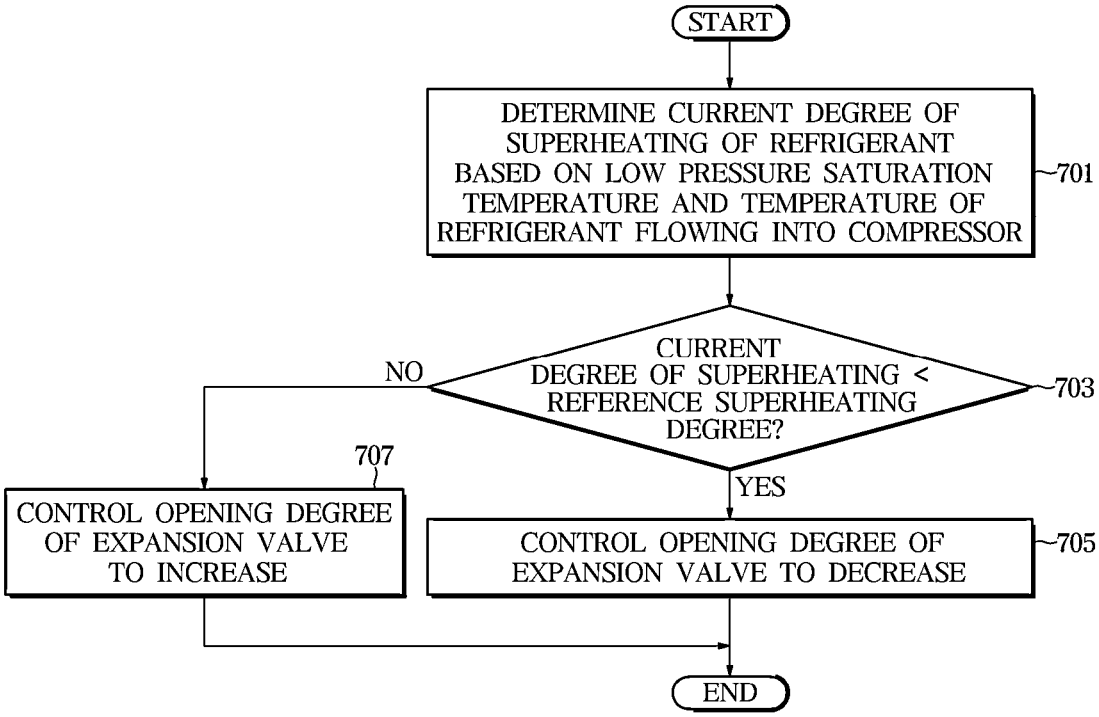
FIG. 7 is a flowchart illustrating example operations of controlling an expansion valve to reach a reference superheating degree according to various embodiments.

FIG. 7 is a flowchart illustrating example operations of controlling an expansion valve to reach a reference superheating degree according to various embodiments.

According to the disclosure, refrigerant leakage may be determined based on a current degree of supercooling of the refrigerant. However, because the same amount of refrigerant may have different degrees of supercooling depending on a degree of superheating of the refrigerant, a degree of superheating is required to be constant before comparing a degree of supercooling.

Accordingly, the controller 10 may control an opening degree of the expansion valve 110 to allow the degree of superheating of the refrigerant to become a reference superheating degree.

The reference superheating degree may be set to a value suitable for detecting refrigerant leak, and may be, for example, 6° C.

The controller 10 may determine a degree of superheating of the refrigerant based on a low pressure saturation temperature of the refrigerant detected by the low pressure sensor 132 and a temperature of the refrigerant flowing into the compressor (701). The temperature of the refrigerant flowing into the compressor may be detected by the compressor intake temperature sensor 124.

For example, the degree of superheating of the refrigerant may be determined according to [Equation 3] below.

$$\text{Degree of superheating} = \{\text{compressor intake temperature} - \text{low pressure saturation temperature}\} \quad \text{[Equation 3]}$$

The controller 10 may compare the determined degree of superheating of the refrigerant with the reference superheating degree (703), and may control the opening degree of the expansion valve 110 to allow the degree of superheating to become the reference superheating degree.

In general, as the opening degree of the expansion valve 110 increases, the degree of superheating of the refrigerant may decrease.

Accordingly, in response to the degree of superheating of the refrigerant being less than the reference superheating degree (Yes in operation 703), the controller 10 may control the opening degree of the expansion valve 110 to decrease (705) so as to increase the degree of superheating.

In response to the degree of superheating of the refrigerant being greater than or equal to the reference superheating degree (No in operation 703), the controller 10 may control the opening degree of the expansion valve 110 to increase (707) so as to decrease the degree of superheating.

As such, by comparing a reference supercooling degree and a current degree of supercooling after the degree of superheating of the refrigerant becomes the reference superheating degree by controlling the opening degree of the expansion valve 110, whether the refrigerant leaks may be determined.

Figure 8:
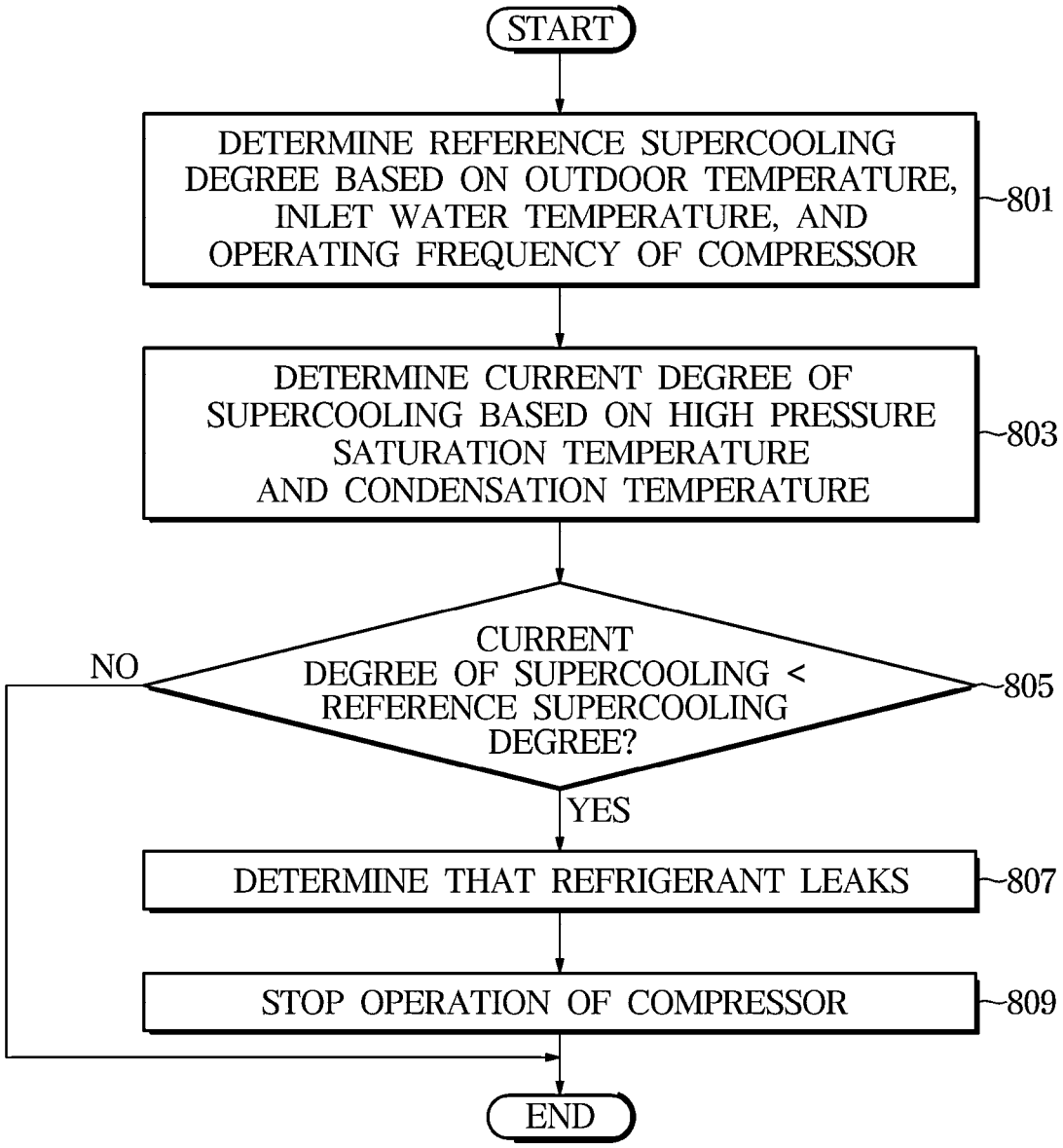
FIG. 8 is a flowchart illustrating example operations of determining whether a refrigerant leak has occurred in a heat pump system according to various embodiments.
Figure 9:
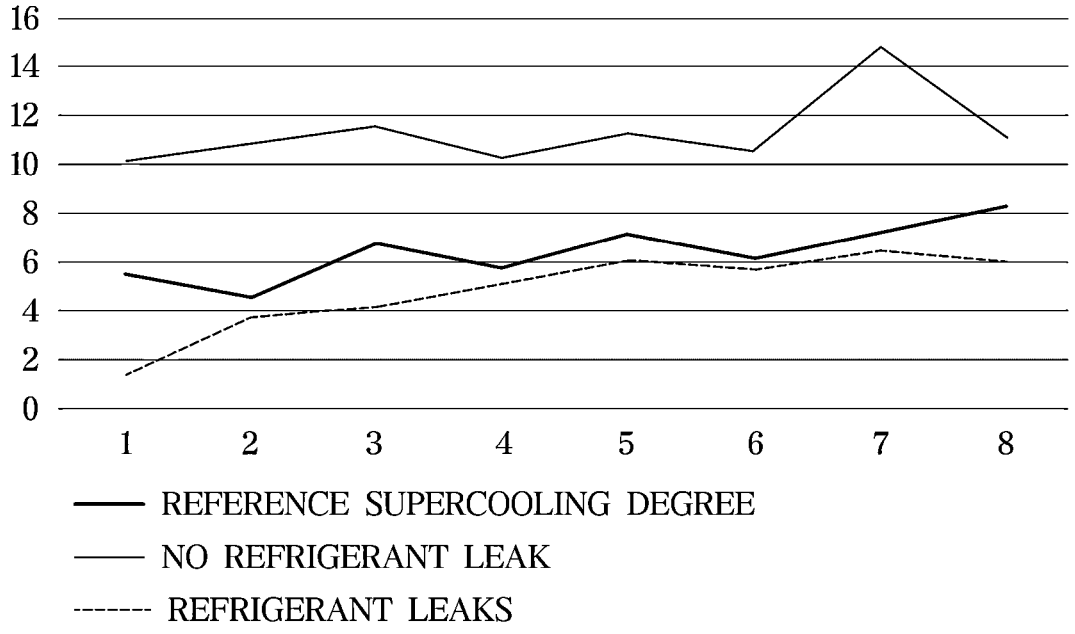
FIG. 9 is a graph illustrating whether a refrigerant leak has occurred based on the amount of refrigerant according to various embodiments.

FIG. 8 is a flowchart illustrating example operations of determining whether a refrigerant leak has occurred in a heat pump system according to various embodiments. FIG. 9 is a graph illustrating whether a refrigerant leak has occurred based on the amount of refrigerant according to various embodiments.

As described above, the controller 10 may determine a reference supercooling degree of a refrigerant (801) based on an outdoor temperature detected by the outdoor temperature sensor 122, an inlet water temperature detected by the inlet water temperature sensor 126, and an operating frequency of the compressor.

The controller 10 may determine a current degree of supercooling of the refrigerant (803) based on a high pressure saturation temperature detected by the high pressure sensor 130 and a temperature of the condensed refrigerant detected by the condensation temperature sensor 120.

The controller 10 may determine that the refrigerant leaks (807), in response to the current degree of supercooling of the refrigerant being less than the reference supercooling degree (Yes in operation 805).

Referring to FIG. 9, in a case where the current degree of supercooling of the refrigerant is greater than or equal to the reference supercooling degree (thick solid line), no refrigerant leak (thin solid line) may be determined, and in a case where the current degree of supercooling of the refrigerant is less than the reference supercooling degree (thick solid line), it may be determined that a refrigerant leak has occurred (dotted line).

Based on a determination that the refrigerant leak has occurred, the controller 10 may stop an operation of the compressor to stop an operation of the heat pump system 1 (809).

Figure 10:
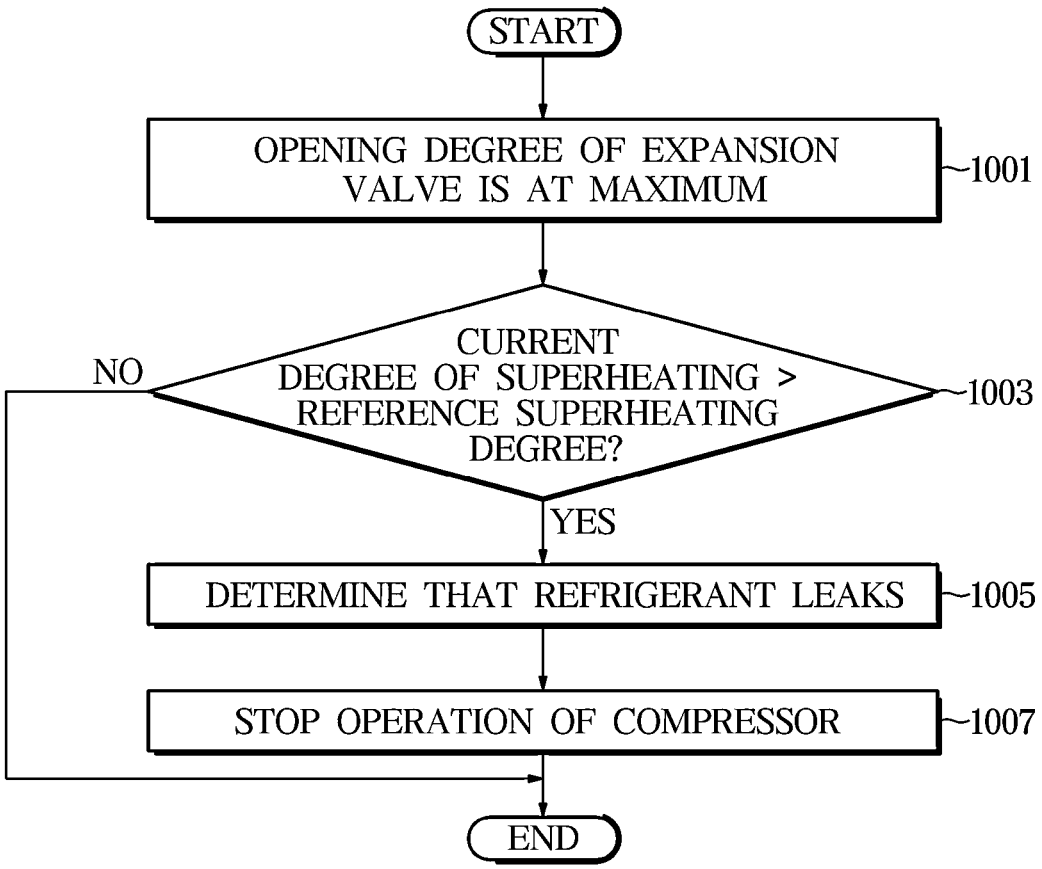
FIG. 10 is a flowchart illustrating example operations of determining whether a refrigerant leak has occurred based on a degree of superheating according to various embodiments.

FIG. 10 is a flowchart illustrating example operations of determining whether a refrigerant leak has occurred based on a degree of superheating according to various embodiments.

As described above, a degree of superheating of a refrigerant may be controlled by controlling an opening degree of the expansion valve 110.

However, in a case where a current degree of superheating of the refrigerant is higher than a reference superheating degree (Yes in operation 1003) even though the opening degree of the expansion valve 110 is at a maximum (1001), the controller 10 may determine that the refrigerant leaks (1005).

The greater the amount of refrigerant leak, the higher the degree of superheating. Accordingly, in a case where the degree of superheating of the refrigerant is higher than the reference superheating degree despite the maximum opening degree of the expansion valve 110, it may be determined that a refrigerant leak has occurred.

Based on a determination that the refrigerant leaks, the controller 10 may stop an operation of the compressor to stop an operation of the heat pump system 1 (1007).

According to an embodiment described above, the degree of supercooling of the refrigerant may be used to determine whether the refrigerant leaks, and thus leakage of a small amount of refrigerant may be detected without stopping the heat pump system 1.

Figure 11:
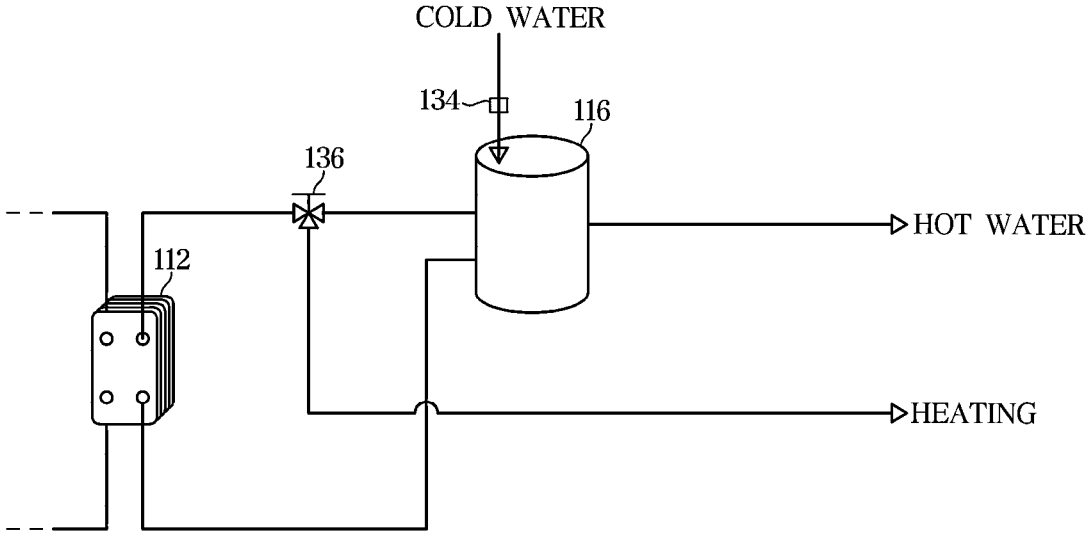
FIG. 11 is a diagram illustrating an example configuration of a heat pump system according to various embodiments.

FIG. 11 is a diagram illustrating an example configuration of a heat pump system according to various embodiments.

Hot water generated through the heat pump system 1 may be used for heating and hot water supply by a 3-way valve 136.

For example, the hot water generated in the heat pump system 1 may be supplied to a radiator for heating an indoor room, and may be supplied as hot water through the hot water tank 116.

In an embodiment of the disclosure, hot water supply through the hot water tank 116 is described. In general, a temperature of the hot water generated by the heat pump system 1 may be raised to be suitable for a temperature of water actually used by users through a heat exchanger in the hot water tank 116.

For the hot water tank 116 for providing such hot water supply, in a case where the temperature inside the hot water tank 116 is lower than a user-set temperature, the heat pump system 1 is operated, and in a case where the temperature inside the hot water tank 116 is higher than the user-set temperature, the heat pump system 1 stops operating. The operation and shutdown are continuously repeated, which may reduce energy efficiency due to heat loss, and thus a power-saving operation is implemented by considering usage pattern learning and hot water heat quantity. In an existing hot water tank equipped with a power-saving operation function, many sensors are required, which complicates design configuration.

Hereinafter, described is the heat pump system 1 that may perform a power-saving operation by predicting a hot water usage pattern and a hot water usage heat quantity without using a plurality of sensors according to an embodiment of the disclosure.

Figure 12:
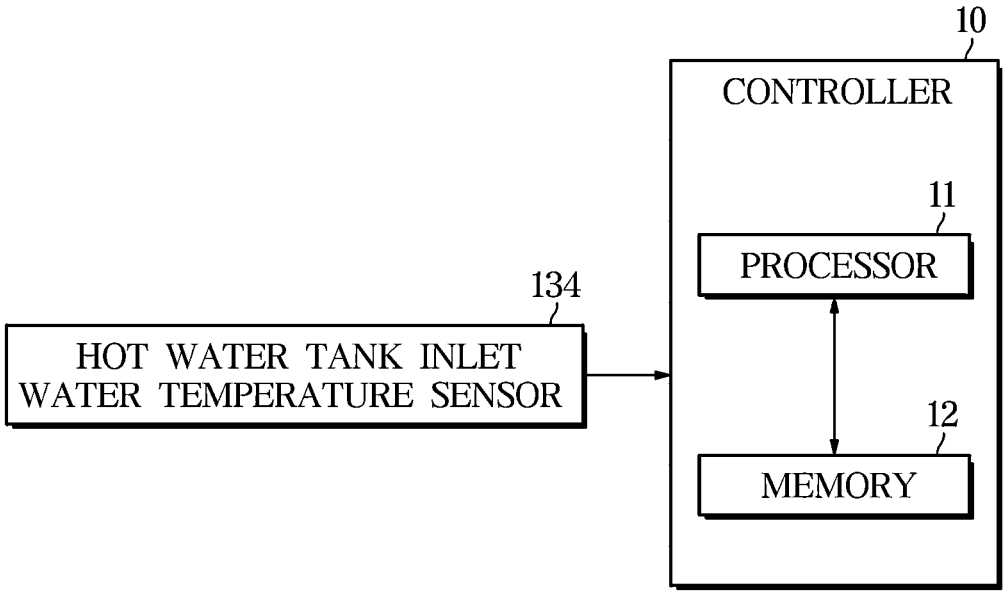
FIG. 12 is a block diagram illustrating an example configuration of a heat pump system according to various embodiments.
Figure 13:
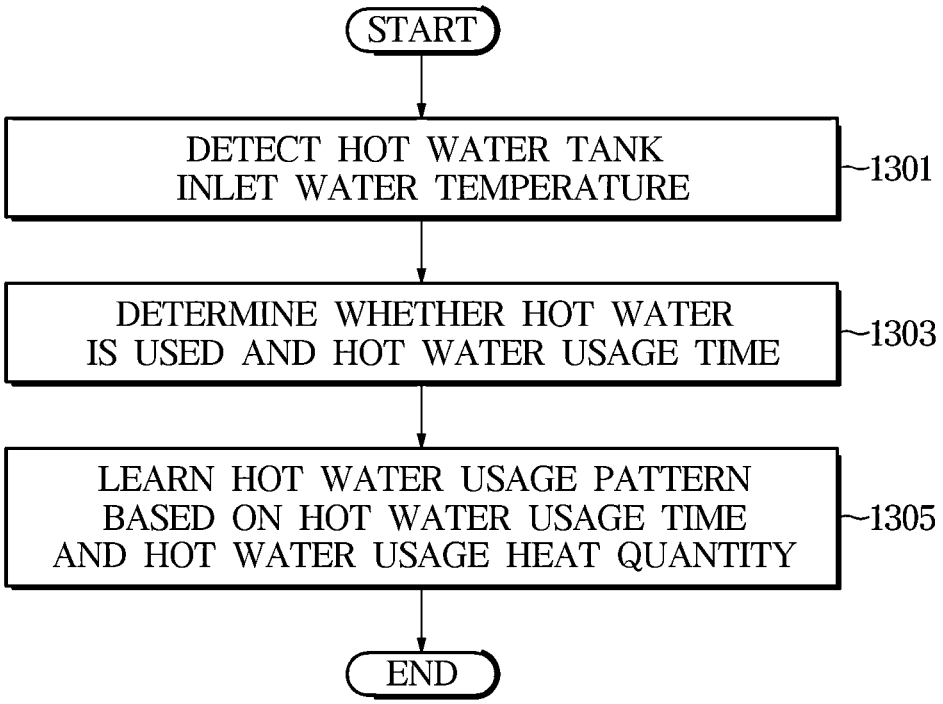
FIG. 13 is a flowchart illustrating an example method for controlling a heat pump system according to various embodiments.

FIG. 12 is a block diagram illustrating an example configuration of a heat pump system according to various embodiments. FIG. 13 is a flowchart illustrating an example method for controlling a heat pump system according to various embodiments.

The heat pump system 1 may further include the hot water tank 116 for supplying hot water, and a hot water tank inlet water temperature sensor 134 for detecting a temperature of water flowing into the hot water tank 116. The hot water tank inlet water temperature sensor 134 may be disposed adjacent to the hot water tank 116.

In response to detection of a temperature of water flowing into the hot water tank 116 by the hot water tank inlet water temperature sensor 134 (1301), the controller 10 may determine whether hot water is used and a hot water usage time based on a detection result of the hot water tank inlet water temperature sensor 134 (1303).

The controller 10 may learn a hot water usage pattern (1305) based on the determination of whether hot water is used and the hot water usage time, thereby performing an optimized operation of the heat pump system 1.

Hereinafter, an example operation of determining a hot water usage time is described in greater detail.

Figure 14:
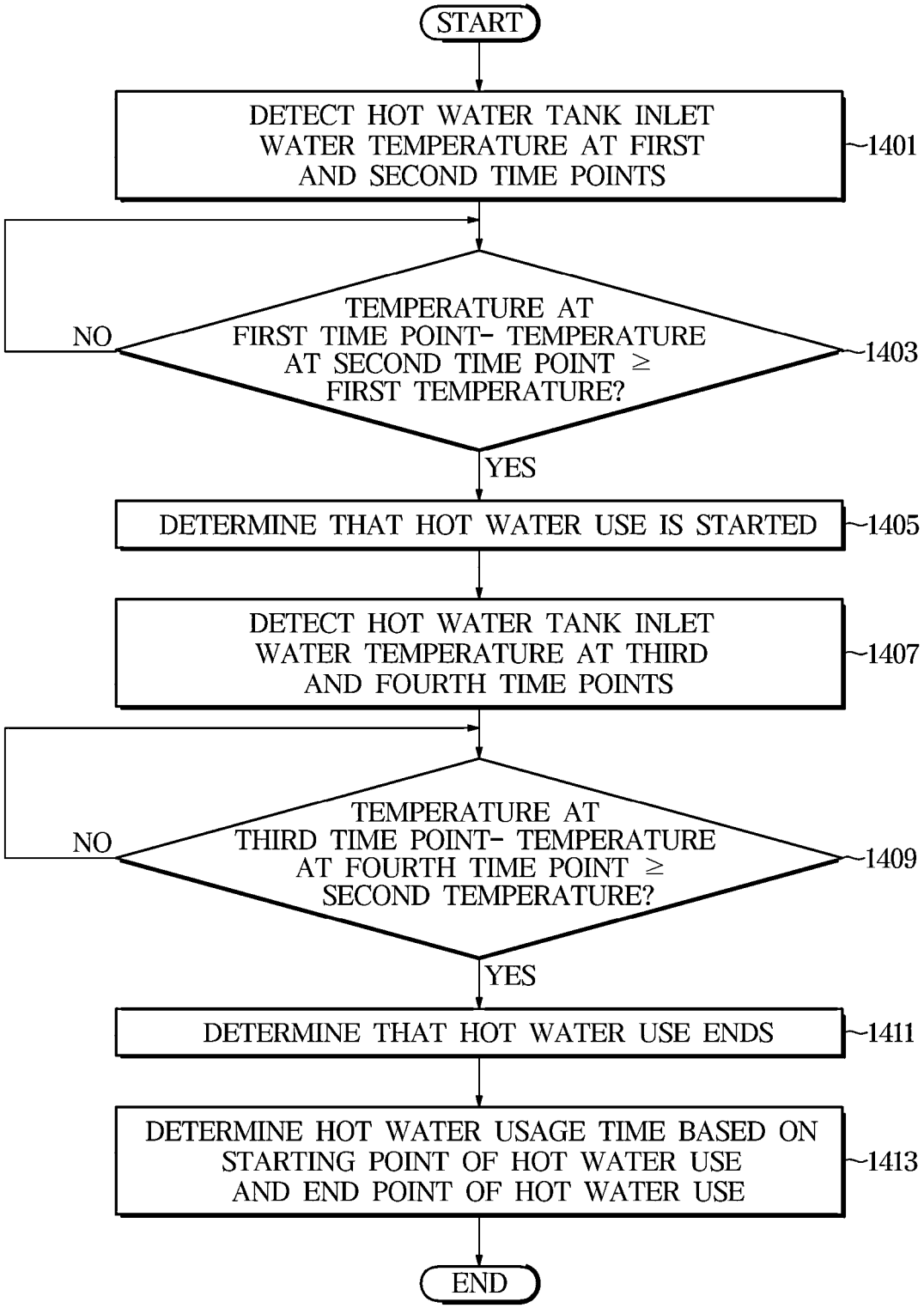
FIG. 14 is a flowchart illustrating example operations of determining a hot water usage time according to various embodiments.
Figure 15:
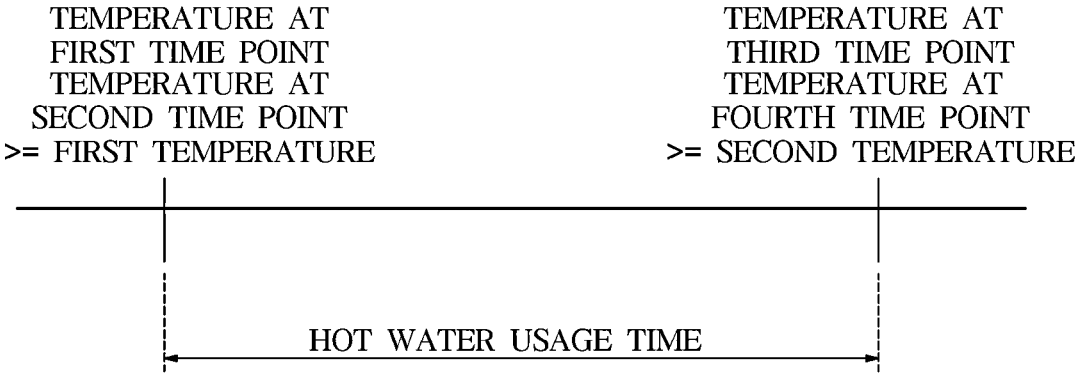
FIG. 15 is a diagram illustrating a hot water usage time according to various embodiments.

FIG. 14 is a flowchart illustrating example operations of determining a hot water usage time according to various embodiments. FIG. 15 is a diagram illustrating a hot water usage time according to various embodiments.

As described above, the hot water tank inlet water temperature sensor 134 may be disposed adjacent to the hot water tank 116, thereby usually maintaining at a relatively high temperature due to heat conducted from the hot water tank 116.

However, in a case where a user, or the like, uses hot water, cold water is introduced into the hot water tank 116, resulting in a rapid decrease in the temperature detected by the hot water tank inlet water temperature sensor 134.

Based on the change in temperature, whether hot water is used and a hot water usage time may be determined.

For example, the controller 10 may determine that use of hot water has started (1405), in response to a difference between a hot water tank inlet water temperature at a first time point (1401) and a hot water tank inlet water temperature at a second time point (1401) being greater than or equal to a first temperature (Yes in operation 1403). In this instance, the second time point is a point in time that is a predetermined (e.g., specified) period of time later than the first time point.

Here, the predetermined period of time may be set to a time suitable for determining whether hot water is used, for example, 10 seconds.

In addition, the first temperature may be set to a temperature suitable for determining whether hot water is used, for example, 1° C.

For example, in a case where the difference between the hot water tank inlet water temperature at the first time point and the hot water tank inlet water temperature at the second time point, which is 10 seconds later than the first time point, is greater than or equal to 1° C., the controller 10 may determine that the temperature has decreased rapidly and determine that the hot water use has started. Here, a starting point of hot water use may be the second time point.

In a case where a user, or the like, ends the hot water use, the inflow of cold water into the hot water tank 116 ends, and thus the temperature detected by the hot water tank inlet water temperature sensor 134 may increase again.

For example, the controller 10 may determine that the use of hot water ends (1411), in response to a difference between a hot water tank inlet water temperature at a third time point (1407) and a hot water tank inlet water temperature at a fourth time point (1407) being greater than or equal to a second temperature (Yes in operation 1409). In this instance, the fourth time point is a point in time that is a predetermined period of time earlier than the third time point.

Here, the predetermined period of time may be set to a time suitable for determining whether the hot water use ends, and may be, for example, 10 seconds.

In addition, the second temperature may be set to a temperature suitable for determining whether the hot water use ends, for example, 0.5° C.

For example, in a case where the difference between the hot water tank inlet water temperature at the third time point and the hot water tank inlet water temperature at the fourth time point, which is 10 seconds earlier than the third time point, is greater than or equal to 0.5° C., the controller 10 may determine that the temperature has increased and determine that the hot water use has ended. Here, an end point of hot water use may be the third time point.

The controller 10 may determine the hot water usage time based on the starting point of hot water use and the end point of hot water use (1413).

For example, as shown in FIG. 15, the controller 10 may determine the hot water usage time as a period of time between the second time point and the third time period, e.g., the second time point when the difference between the hot water tank inlet water temperature at the first time point and the hot water tank inlet water temperature at the second time point is greater than or equal to the first temperature, and the third time point when the difference between the hot water tank inlet water temperature at the third time point and the hot water tank inlet water temperature at the fourth time point is greater than or equal to the second temperature.

The controller 10 may learn a hot water usage pattern and determine a hot water usage heat quantity for optimized operation of the heat pump system 1.

For example, the hot water usage heat quantity may be determined according to [Equation 4] below.

$$\text{Hot water usage heat quantity} = \text{Generated heat quantity} - \text{Heat loss quantity} - (\text{Current hot water heat quantity} - \text{Previous hot water heat quantity}) \quad \text{[Equation 4]}$$

The controller 10 may determine the hot water usage heat quantity and learn the hot water usage pattern based on the determined hot water usage heat quantity and hot water usage time.

For example, with an assumption that the hot water usage heat quantity is 1000, in a case where the hot water has been used four times for 10 minutes, 20 minutes, 30 minutes, and 40 minutes, respectively, the hot water usage heat quantity for each time may be determined and stored as 100, 200, 300, and 400, respectively.

By determining and learning the hot water usage patterns of users, and the like, hot water storage heat quantity may be predicted for an optimized startup and shutdown of the heat pump system, and thus a power-saving operation may be performed.

According to an embodiment of the disclosure, without using multiple sensors, the hot water usage pattern and the hot water usage heat quantity may be predicted and a power-saving operation may be performed, and thus cost reduction and simplified design may be achieved while performing the power-saving operation.

According to an example embodiment, a heat pump system may include: a compressor configured to compress a refrigerant; a refrigerant-water heat exchanger configured to perform heat exchange between the compressed refrigerant and inlet water; an expansion valve configured to expand the refrigerant condensed in the refrigerant-water heat exchanger; an outdoor heat exchanger configured to perform heat exchange between the refrigerant expanded in the expansion valve and outdoor air; a high pressure sensor configured to detect a high pressure saturation temperature of the refrigerant compressed in the compressor; an inlet water temperature sensor configured to detect a temperature of water flowing into the refrigerant-water heat exchanger; a condensation temperature sensor configured to detect a temperature of the refrigerant condensed in the refrigerant-water heat exchanger; an outdoor temperature sensor configured to detect an outdoor temperature; and a controller, comprising at least one processor, comprising processing circuitry, individually and/or collectively, configured to: determine a reference supercooling degree of the refrigerant based on detection results of the outdoor temperature sensor and the inlet water temperature sensor and an operating frequency of the compressor, determine a current degree of supercooling of the refrigerant based on detection of the high pressure sensor and the condensation temperature sensor, and determine whether the refrigerant leaks by comparing the reference supercooling degree and the current degree of supercooling.

According to an example embodiment of the disclosure, whether a refrigerant leak has occurred may be determined based on the degree of supercooling of refrigerant, thereby detecting even small amount of refrigerant leakage without stopping the heat pump system.

According to an example embodiment, the controller may be configured to determine that the refrigerant leaks, in response to the current degree of supercooling of the refrigerant being less than the reference supercooling degree.

According to an example embodiment, the controller may be configured to stop an operation of the compressor based on a determination that the refrigerant leaks.

According to an example embodiment, the controller may be configured to: control an opening degree of the expansion valve to allow a degree of superheating of the refrigerant to become a reference superheating degree, and determine whether the refrigerant leaks by comparing the reference supercooling degree and the current degree of supercooling after the degree of superheating of the refrigerant becomes the reference superheating degree.

According to an example embodiment, the heat pump system may further include: a low pressure sensor configured to detect a low pressure saturation temperature of the refrigerant compressed in the compressor; and a compressor intake temperature sensor configured to detect a temperature of the refrigerant flowing into the compressor. The controller may be configured to determine the degree of superheating of the refrigerant based on detection results of the low pressure sensor and the compressor intake temperature sensor.

According to an example embodiment, the controller may be configured to determine that the refrigerant leaks, in response to a current degree of superheating of the refrigerant being higher than the reference superheating degree in a state where the opening degree of the expansion valve is at a maximum.

According to an example embodiment, the heat pump system may further include: a hot water tank configured to supply hot water; and a hot water tank inlet water temperature sensor configured to detect a temperature of water flowing into the hot water tank. The controller may be configured to determine whether the hot water is used and a hot water usage time based on a detection result of the hot water tank inlet water temperature sensor.

According to the disclosure, without using multiple sensors, a power-saving operation may be performed by predicting a hot water usage pattern and a hot water usage heat quantity, and thus cost reduction and simplified design may be achieved while performing the power-saving operation.

According to an example embodiment, the controller may be configured to determine that use of the hot water is started, in response to a difference between a hot water tank inlet water temperature at a first time point and a hot water tank inlet water temperature at a second time point being greater than or equal to a first temperature, the second time point being a point in time that is a predetermined period of time later than the first time point.

According to an example embodiment, the controller may be configured to determine that the use of the hot water ends, in response to a difference between a hot water tank inlet water temperature at a third time point and a hot water tank inlet water temperature at a fourth time point being greater than or equal to a second temperature, the fourth time point being a point in time that is a predetermined period of time earlier than the third time point.

According to an example embodiment, the controller may be configured to determine the hot water usage time based on a time point that the use of the hot water is started and a time point that the use of the hot water ends.

According to an example embodiment, the controller may be configured to determine a hot water usage heat quantity, and learn a hot water usage pattern based on the hot water usage heat quantity and the hot water usage time.

According to an example embodiment, a method for controlling a heat pump system including a compressor configured to compress a refrigerant; a refrigerant-water heat exchanger configured to perform heat exchange between the compressed refrigerant and inlet water; an expansion valve configured to expand the refrigerant condensed in the refrigerant-water heat exchanger; an outdoor heat exchanger configured to perform heat exchange between the refrigerant expanded in the expansion valve and outdoor air; a high pressure sensor configured to detect a high pressure saturation temperature of the refrigerant compressed in the compressor; an inlet water temperature sensor configured to detect a temperature of water flowing into the refrigerant-water heat exchanger; a condensation temperature sensor configured to detect a temperature of the refrigerant condensed in the refrigerant-water heat exchanger; and an outdoor temperature sensor configured to detect an outdoor temperature, the method may include: determining a reference supercooling degree of the refrigerant based on detection of the outdoor temperature sensor and the inlet water temperature sensor and an operating frequency of the compressor; determining a current degree of supercooling of the refrigerant based on detection results of the high pressure sensor and the condensation temperature sensor; and determining whether the refrigerant leaks by comparing the reference supercooling degree and the current degree of supercooling.

According to an example embodiment, the determining of whether the refrigerant leaks may include determining that the refrigerant leaks, in response to the current degree of supercooling of the refrigerant being less than the reference supercooling degree.

According to an example embodiment, the method may further include stopping an operation of the compressor based on a determination that the refrigerant leaks.

According to an example embodiment, the method may further include controlling an opening degree of the expansion valve to allow a degree of superheating of the refrigerant to become a reference superheating degree. The determining of whether the refrigerant leaks may include determining whether the refrigerant leaks by comparing the reference supercooling degree and the current degree of supercooling after the degree of superheating of the refrigerant becomes the reference superheating degree.

According to an example embodiment, the heat pump system may further include: a low pressure sensor configured to detect a low pressure saturation temperature of the refrigerant compressed in the compressor; and a compressor intake temperature sensor configured to detect a temperature of the refrigerant flowing into the compressor. The allowing of the degree of superheating of the refrigerant to become a reference superheating degree may include determining the degree of superheating of the refrigerant based on detection results of the low pressure sensor and the compressor intake temperature sensor.

According to an example embodiment, the determining of whether the refrigerant leaks may include determining that the refrigerant leaks, in response to a current degree of superheating of the refrigerant being higher than the reference superheating degree in a state where the opening degree of the expansion valve is at a maximum.

According to an example embodiment, the heat pump system may further include: a hot water tank configured to supply hot water; and a hot water tank inlet water temperature sensor configured to detect a temperature of water flowing into the hot water tank. The method may further include determining whether the hot water is used and a hot water usage time based on a detection result of the hot water tank inlet water temperature sensor.

According to an example embodiment, the determining of the hot water usage time may include determining that use of the hot water is started, in response to a difference between a hot water tank inlet water temperature at a first time point and a hot water tank inlet water temperature at a second time point being greater than or equal to a first temperature, the second time point being a point in time that is a predetermined period of time later than the first time point.

According to an example embodiment, the determining of the hot water usage time may include determining that the use of the hot water ends, in response to a difference between a hot water tank inlet water temperature at a third time point and a hot water tank inlet water temperature at a fourth time point being greater than or equal to a second temperature, the fourth time point being a point in time that is a predetermined period of time earlier than the third time point.

According to an example embodiment, the determining of the hot water usage time may include determining the hot water usage time based on a time point that the use of the hot water is started and a time point that the use of the hot water ends.

According to an example embodiment, the method may further include determining a hot water usage heat quantity, and learning a hot water usage pattern based on the hot water usage heat quantity and the hot water usage time.

According to an aspect of the disclosure, whether a refrigerant leak has occurred may be determined based on a degree of supercooling of refrigerant, thereby detecting even small amount of refrigerant leakage without stopping a heat pump system.

According to another aspect of the disclosure, without using multiple sensors, a power-saving operation may be performed by predicting a hot water usage pattern and a hot water usage heat quantity, and thus cost reduction and simplified design may be achieved while performing the power-saving operation.

The disclosed embodiments may be implemented in the form of a recording medium that stores instructions executable by a computer. The instructions may be stored in the form of program codes, and when executed by a processor, the instructions may create a program module to perform operations of the disclosed embodiments. The recording medium may be implemented as a non-transitory computer-readable recording medium.

The computer-readable recording medium may include all kinds of recording media storing instructions that may be interpreted by a computer. For example, the computer-readable recording medium may be a Read Only Memory (ROM), a Random Access Memory (RAM), a magnetic tape, a magnetic disk, a flash memory, an optical data storage device, etc.

While the disclosure has been illustrated and described with reference to various example embodiments, it will be understood that the various example embodiments are intended to be illustrative, not limiting. It will be further understood by those skilled in the art that various changes and modifications may be made in without departing from the principles, spirit and scope of the disclosure, including the appended claims and their equivalents. It will also be understood that any of the embodiment(s) described herein may be used in conjunction with any other embodiment(s) described herein.

What is claimed is:

1. A heat pump system, comprising:

a compressor configured to compress a refrigerant;

a refrigerant-water heat exchanger configured to perform heat exchange between compressed refrigerant from the refrigerant-water heat exchanger and inlet water;

an expansion valve configured to expand the refrigerant condensed in the refrigerant-water heat exchanger;

an outdoor heat exchanger configured to perform heat exchange between the refrigerant expanded in the expansion valve and outdoor air;

a high pressure sensor configured to detect a high pressure saturation temperature of the refrigerant compressed in the compressor;

an inlet water temperature sensor configured to detect a temperature of water flowing into the refrigerant-water heat exchanger;

a condensation temperature sensor configured to detect a temperature of the refrigerant from the the refrigerant-water heat exchanger;

an outdoor temperature sensor configured to detect an outdoor temperature; and a controller, comprising at least one processor, comprising processing circuitry, individually and/or collectively, configured to: determine a reference supercooling degree of the refrigerant based on the detection of outdoor temperature by the outdoor temperature sensor and the inlet water temperature by the inlet water temperature sensor and an operating frequency of the compressor, determine a current degree of supercooling of the refrigerant based on detection of the high pressure saturation temperature by the high pressure sensor and condensed refrigerant temperature detected by the condensation temperature sensor, and determine whether the refrigerant leaks by comparing the reference supercooling degree and the current degree of supercooling.

2. The heat pump system of claim 1, wherein the controller is configured to determine that the refrigerant leaks, in response to the current degree of supercooling of the refrigerant being less than the reference supercooling degree.

3. The heat pump system of claim 2, wherein the controller is configured to stop an operation of the compressor based on a determination that the refrigerant leaks.

4. The heat pump system of claim 1, wherein the controller is configured to control an opening degree of the expansion valve to allow a degree of superheating of the refrigerant to become a reference superheating degree, and determine whether the refrigerant leaks by comparing the reference supercooling degree and the current degree of supercooling after the degree of superheating of the refrigerant becomes the reference superheating degree.

5. The heat pump system of claim 4, further comprising:

a low pressure sensor configured to detect a low pressure saturation temperature of the refrigerant compressed in the compressor; and a compressor intake temperature sensor configured to detect a temperature of the refrigerant flowing into the compressor, wherein the controller is configured to determine the degree of superheating of the refrigerant based on the pressure detection of the low pressure sensor and the temperature detection by the compressor intake temperature sensor.

6. The heat pump system of claim 4, wherein the controller is configured to determine that the refrigerant leaks, in response to a current degree of superheating of the refrigerant being higher than the reference superheating degree in a state where the opening degree of the expansion valve is at a maximum.

7. The heat pump system of claim 1, further comprising:

a hot water tank configured to supply hot water; and a hot water tank inlet water temperature sensor configured to detect a temperature of water flowing into the hot water tank, wherein the controller is configured to determine whether the hot water is used and a hot water usage time based on a detection of the hot water tank inlet water temperature by the hot water tank inlet water temperature sensor.

8. The heat pump system of claim 7, wherein the controller is configured to determine that use of the hot water is started, in response to a difference between a hot water tank inlet water temperature at a first time point and a hot water tank inlet water temperature at a second time point being greater than or equal to a first temperature, the second time point being a point in time a specified period of time later than the first time point.

9. The heat pump system of claim 8, wherein the controller is configured to determine that the use of the hot water ends, in response to a difference between a hot water tank inlet water temperature at a third time point and a hot water tank inlet water temperature at a fourth time point being greater than or equal to a second temperature, the fourth time point being a point in time a specified period of time earlier than the third time point.

10. The heat pump system of claim 9, wherein the controller is configured to determine the hot water usage time based on a time point that the use of the hot water is started and a time point that the use of the hot water ends.

11. The heat pump system of claim 10, wherein the controller is configured to determine a hot water usage heat quantity, and learn a hot water usage pattern based on the hot water usage heat quantity and the hot water usage time.

12. A method for controlling a heat pump system comprising a compressor configured to compress a refrigerant; a refrigerant-water heat exchanger configured to perform heat exchange between compressed refrigerant and inlet water; an expansion valve configured to expand the refrigerant from the refrigerant-water heat exchanger; an outdoor heat exchanger configured to perform heat exchange between the refrigerant expanded in the expansion valve and outdoor air; a high pressure sensor configured to detect a high pressure saturation temperature of the refrigerant compressed by the compressor; an inlet water temperature sensor configured to detect a temperature of water flowing into the refrigerant-water heat exchanger; a condensation temperature sensor configured to detect a temperature of the refrigerant from and/or in the the refrigerant-water heat exchanger; and an outdoor temperature sensor configured to detect an outdoor temperature, the method comprising:

determining a reference supercooling degree of the refrigerant based on the detection of the outdoor temperature by the outdoor temperature sensor and the inlet water temperature sensor by the inlet water temperature sensor and an operating frequency of the compressor;

determining a current degree of supercooling of the refrigerant based on the detection of pressure saturation temperature by the high pressure sensor and the condensation temperature by the condensation temperature sensor; and determining whether the refrigerant leaks by comparing the reference supercooling degree and the current degree of supercooling.

13. The method of claim 12, wherein the determining of whether the refrigerant leaks comprises determining that the refrigerant leaks, in response to the current degree of supercooling of the refrigerant being less than the reference supercooling degree.

14. The method of claim 13, further comprising:

stopping an operation of the compressor based on a determination that the refrigerant leaks.

15. The method of claim 12, further comprising:

controlling an opening degree of the expansion valve to allow a degree of superheating of the refrigerant to become a reference superheating degree, wherein the determining of whether the refrigerant leaks comprises determining whether the refrigerant leaks by comparing the reference supercooling degree and the current degree of supercooling after the degree of superheating of the refrigerant becomes the reference superheating degree.

* * * * *